US009080427B2

(12) United States Patent
Ghasripoor et al.

(10) Patent No.: US 9,080,427 B2
(45) Date of Patent: Jul. 14, 2015

(54) SEABED WELL INFLUX CONTROL SYSTEM

(75) Inventors: Farshad Ghasripoor, Glenville, NY (US); Christopher Edward Wolfe, Niskayuna, NY (US); Thomas James Batzinger, Burnt Hills, NY (US); Gary Dwayne Mandrusiak, Latham, NY (US); Robert Arnold Judge, Houston, TX (US)

(73) Assignee: General Electric Company, Niskayuna, NY (US)

( * ) Notice: Subject to any disclaimer, the term of this patent is extended or adjusted under 35 U.S.C. 154(b) by 506 days.

(21) Appl. No.: 13/483,713

(22) Filed: May 30, 2012

(65) Prior Publication Data

US 2013/0140034 A1 Jun. 6, 2013

Related U.S. Application Data

(60) Provisional application No. 61/566,091, filed on Dec. 2, 2011.

(51) Int. Cl.

| | |
|---|---|
| ***E21B 21/08*** | (2006.01) |
| ***E21B 33/06*** | (2006.01) |
| ***E21B 47/06*** | (2012.01) |
| ***E21B 17/10*** | (2006.01) |
| ***E21B 33/08*** | (2006.01) |

(52) U.S. Cl.

CPC ..... *E21B 47/06* (2013.01); *E21B 17/1078* (2013.01); *E21B 21/08* (2013.01); *E21B 33/062* (2013.01); *E21B 33/085* (2013.01)

(58) Field of Classification Search

CPC ..... E21B 7/12; E21B 17/10; E21B 17/1078; E21B 21/08; E21B 33/062; E21B 33/064; E21B 33/085; E21B 47/06

USPC ..... 166/342, 345, 349, 358, 363, 368, 373, 166/84.2; 175/5, 48, 207

See application file for complete search history.

(56) References Cited

U.S. PATENT DOCUMENTS

| | | | | |
|---|---|---|---|---|
| 4,273,212 | A * | 6/1981 | Dorr et al. | 181/102 |
| 4,640,372 | A * | 2/1987 | Davis | 175/208 |
| 5,006,845 | A * | 4/1991 | Calcar et al. | 367/81 |
| 5,163,029 | A * | 11/1992 | Bryant et al. | 367/83 |
| 5,662,171 | A | 9/1997 | Brugman et al. | |

(Continued)

OTHER PUBLICATIONS

Judge, Robert Arnold et al.; "Mudline Managed Pressure Drilling and Enhanced Influx Detection"; Pending U.S. Appl. No. 13/050,164, filed Mar. 17, 2011; 24 pages (19 pages specification/5 pages drawings).

*Primary Examiner* — Matthew Buck
(74) *Attorney, Agent, or Firm* — Andrew J. Caruso

(57) ABSTRACT

Apparatuses useable in an offshore drilling installation close to the seabed for controlling well influx within a wellbore are provided. An apparatus includes a centralizer and flow constrictor assembly, a sensor and a controller. The centralizer and flow constrictor assembly are configured to centralize a drill string within a drill riser and regulate a return mud flow. The sensor is located close to the centralizer and flow constrictor assembly and configured to acquire values of at least one parameter related to the return mud flow. The controller is coupled to the centralizer and flow constrictor assembly and the sensor. The controller is configured to control the centralizer and flow constrictor assembly to achieve a value of a control parameter close to a predetermined value, based on the values acquired by the sensor.

18 Claims, 6 Drawing Sheets

(56) References Cited

U.S. PATENT DOCUMENTS

| | | | | |
|---|---|---|---|---|
| 6,571,873 | B2 * | 6/2003 | Maus | 166/250.07 |
| 6,877,565 | B2 * | 4/2005 | Edvardsen | 166/352 |
| 6,904,982 | B2 | 6/2005 | Judge et al. | |
| 7,270,185 | B2 * | 9/2007 | Fontana et al. | 166/358 |
| 7,497,266 | B2 * | 3/2009 | Fossli | 166/358 |
| 7,562,723 | B2 | 7/2009 | Reitsma | |
| 7,650,950 | B2 * | 1/2010 | Leuchtenberg | 175/48 |
| 7,866,399 | B2 | 1/2011 | Kozicz et al. | |
| 8,403,059 | B2 * | 3/2013 | Hughes et al. | 166/367 |
| 2008/0023917 | A1 | 1/2008 | Khandoker et al. | |
| 2009/0294129 | A1 | 12/2009 | Judge et al. | |
| 2010/0175882 | A1 * | 7/2010 | Bailey et al. | 166/335 |
| 2010/0218937 | A1 * | 9/2010 | Edvardsen et al. | 166/84.2 |
| 2013/0192847 | A1 * | 8/2013 | Bailey et al. | 166/373 |

* cited by examiner

SEABED WELL INFLUX CONTROL SYSTEM

CROSS-REFERENCE TO RELATED APPLICATIONS

This application is a non-provisional application that claims priority to provisional U.S. patent application Ser. No. 61/566,091 filed on Dec. 2, 2011; the disclosure of which is hereby incorporated by reference.

BACKGROUND

Embodiments disclosed herein relate generally to methods and apparatus for controlling well influx within a wellbore. In particular, embodiments disclosed herein relate to methods to design and assemble well influx control systems.

During the past years, with the increase in price of fossil fuels, the interest in developing new production fields has dramatically increased. However, the availability of land-based production fields is limited. Thus, the industry has now extended drilling to offshore locations, which appear to hold a vast amount of fossil fuel.

A traditional offshore oil and gas installation 10, as illustrated in FIG. 1, includes a platform 20 (of any other type of vessel at the water surface) connected via a riser 30 to a wellhead 40 on the seabed 50. It is noted that the elements shown in FIG. 1 are not drawn to scale and no dimensions should be inferred from relative sizes and distances illustrated in FIG. 1.

Inside the riser 30, as shown in the cross-section view, there is a drill string 32 at the end of which a drill bit (not shown) is rotated to extend the subsea well through layers below the seabed 50. Mud is circulated from a mud tank (not shown) on the drilling platform 20 through the drill string 32 to the drill bit, and returned to the drilling platform 20 through an annular space 34 between the drill string 32 and a casing 36 of the riser 30. The mud maintains a hydrostatic pressure to counterbalancing the pressure of fluids coming out of the well and cools the drill bit while also carrying crushed or cut rock to the surface. At the surface, the mud returning from the well is filtered to remove the rock, and re-circulated.

Offshore oil and gas exploration requires many safety well control devices to be put in place during drilling activities to prevent injury to personnel and destruction of equipment. During oil and gas exploration, the many layers being drilled through may contain trapped fluids or gases at different pressures. To balance these varying pressures, during the drilling process, the pressure in the wellbore is generally adjusted to at least balance the formation pressure. Some of the methods that may be utilized to balance these pressures include, but are not limited to, increasing a density of drilling mud in the wellbore or increasing pump pressure at the surface of the well.

During the drilling process, when a layer is encountered that includes a substantially higher pressure than that of the wellbore, the well may be described as having encountered a "kick". A kick is commonly detected by monitoring the changes in level of drilling mud which returns from the annulus on the drilling ship as well as well pressure. If the burst is not promptly controlled, the well and the equipment of the installation may be damaged. Blowout preventers (BOPs) are one type of well control device that is often used to close, isolate, and seal a wellbore during a high pressure event or kick. Blowout preventers are typically installed at the surface or on the sea floor in deep water drilling arrangements so that kicks may be adequately controlled and "circulated out" of the system. Blowout preventers operate in a similar manner as large valves that are connected to the wellhead and comprise closure members configured to seal and close the well in order to prevent the release of high-pressure gas or liquids from the well. In addition, choke and kill lines are used to control the kick by adding denser mud. Although there are many types of blowout preventers, the most common are annular blowout preventers and ram-type blowout preventers. In a preferred arrangement, annular blowout preventers are typically located at the top of a blowout preventer stack, with one or two annular preventers positioned above a series of several ram-type preventers.

Referring again to FIG. 1, during drilling, gas, oil or other well fluids at a high pressure may burst from the drilled formations into the riser 30 and may occur at unpredictable moments. In order to protect the well and/or the equipment that may be damaged, a blowout preventer (BOP) stack 60 is located close to the seabed 50. The BOP stack may include a lower BOP stack 62 attached to the wellhead 40, and a Lower Marine Riser Package ("LMRP") 64, which is attached to a distal end of the riser 30. During drilling, the lower BOP stack 62 and the LMRP 64 are connected.

A plurality of blowout preventers (BOPs) 66 located in the lower BOP stack 62 or in the LMRP 64 are in an open state during normal operation, but may be closed (i.e., switched to a close state) to interrupt a fluid flow through the riser 30 when a "kick" occurs. Electrical cables and/or hydraulic lines 70 transport control signals from the drilling platform 20 to a controller 80, which is located on the BOP stack 60. The controller 80 controls the BOPs 66 to be in the open state or in the closed state, according to signals received from the platform 20 via the electrical cables and/or hydraulic lines 70. The controller 80 also acquires and sends to the platform 20, information related to the current state (open or closed) of the BOPs. The term "controller" used here covers the well-known configuration with two redundant pods.

Traditionally, as described, for example, in U.S. Pat. Nos. 7395,878, 7,562,723, and 7,650,950 (the entire contents of which are incorporated by reference herein), a mud flow output from the well is measured at the surface of the water by sensing device including a float in a mud tank. The mud flow input into the well may be adjusted to maintain a pressure at the bottom of the well within a targeted range or around a desired value, or to compensate for kicks and fluid losses.

In one particular scenario, when a kick is detected based on feedback from the sensing device, drilling is stopped, the blowout preventer valves (internal and external to the drill pipe) are closed and heavier drilling mud is pumped down the well bore through kill lines, while a choke line is used to control the flow. When the kick has been controlled, heavier drilling mud replaces the earlier lighter mud in the drill pipe, the choke and kill lines are closed, the blowout preventers are opened and drilling is resumed. As stated, when a kick is detected, the drilling must be stopped, in part due to the lack of a rotating wellhead. Alternative devices have been proposed that allow for continuation of drilling through the use of a rotating wellhead that must be configured as an additional, separate device assembled as part of the drill string below the drill ship and prior to the commencement of drilling. The rotating wellheads are not configured as an integral part of the BOP stack and require substantial amounts of additional seals to stop the flow of mud through the annulus. In addition, hydrostatic bearings and external lubrication systems are needed to allow for rotation of the drill pipe within the rotating wellhead.

Another problem with the existing methods and devices is the relative long time (e.g., tens of minutes) between a moment when a disturbance of the mud flow occurs at the bottom of the well and when a change of the mud flow is measured at the surface. Even if information indicating a potential disturbance of the mud flow is received from the controller 80 faster, a relative long time passes between when an input mud flow is changed and when this change has a counter-balancing impact at the bottom of the well.

Accordingly, there exists a need for an influx control system that allows for the continuation of drilling activities during the presence of a substantially higher pressure than that of the wellbore. More particularly, there exists a need for an influx control system that eliminates the need to stop drilling during the presence of a potential blowout condition and during regulation of the mud flow to prevent a blowout from occurring. In addition, there exists a need for an influx control system that allows for sensing of the presence of a substantially higher pressure in a manner that allows for a reduction in response time than current technologies.

BRIEF DESCRIPTION

In accordance with an embodiment, an apparatus useable in an offshore drilling installation close to the seabed for controlling well influx within a wellbore is provided. The apparatus including a centralizer and flow constrictor assembly, a sensor, and a controller. The centralizer and flow constrictor assembly is configured to centralize a drill string within a drill riser and regulate a return mud flow. The sensor is located close to the centralizer and flow constrictor assembly and configured to acquire values of at least one parameter related to the return mud flow. The controller is coupled to the centralizer and flow constrictor assembly and the sensor. The controller is configured to control the centralizer and flow constrictor assembly to achieve a value of a control parameter close to a predetermined value, based on the values acquired by the sensor.

In accordance with another embodiment, an apparatus useable in an offshore drilling installation close to the seabed for controlling well influx within a wellbore is provided. The apparatus including a drill riser, a centralizer and flow constrictor assembly, a sensor and a controller. The drill riser including a cavity extending from an annular space through which a return mud flow passes. The annular space surrounding a drill string through which mud flows towards a top of the well. The centralizer and flow constrictor assembly comprising a centralizer component configured to centralize the drill string within the drill riser and a flow constrictor component configured to regulate the return mud flow. The sensor is located close to the seabed and configured to acquire values of at least one parameter related to the return mud flow. The controller is coupled to the centralizer and flow constrictor assembly and the sensor. The controller is configured to control the centralizer and flow constrictor assembly to achieve a value of a control parameter close to a predetermined value, based on the values acquired by the sensor.

In accordance with another embodiment, an apparatus useable in an offshore drilling installation close to the seabed for controlling well influx within a wellbore is provided. The apparatus including a drill riser, a centralizer and flow constrictor assembly, a sensor and a controller. The drill riser including a cavity extending from an annular space through which a return mud flow passes. The annular space surrounding a drill string through which mud flows towards a top of the well. The centralizer and flow constrictor assembly including a first centralizer component, a spaced apart second centralizer component and a flow constrictor component. The sensor being disposed between the first and second centralizer components. The flow constrictor component including a throttle plate disposed on an uppermost surface of the second centralizer component and including an opening therein for the return mud flow. The throttle plate operable to regulate the return mud flow. The centralizer and flow constrictor assembly further including a flexible bearing and a ram plate. The flexible bearing including a bearing surface configured to seal about the drill string while allowing rotation of the drill string. The ram plate having an opening therein for the return mud flow. The sensor is located close to the seabed and configured to acquire values of at least one parameter related to the return mud flow. The controller is coupled to the centralizer and flow constrictor assembly and the sensor. The controller is configured to control the centralizer and flow constrictor assembly to achieve a value of a control parameter close to a predetermined value, based on the values acquired by the sensor.

Other aspects and advantages of the invention will be apparent upon reading the following detailed description and the appended claims with reference to the accompanying drawings.

BRIEF DESCRIPTION OF THE FIGURES

The above and other features, aspects, and advantages of the present disclosure will become better understood when the following detailed description is read with reference to the accompanying drawings in which like characters represent like parts throughout the drawings, wherein.

DETAILED DESCRIPTION

Preferred embodiments of the present disclosure are illustrated in the figures like numerals being used to refer to like and corresponding parts of the various drawings. It is also understood that terms such as "top", "bottom", "outward", "inward", and the like are words of convenience and are not to be construed as limiting terms. It is to be noted that the terms "first," "second," and the like, as used herein do not denote any order, quantity, or importance, but rather are used to distinguish one element from another. The terms "a" and "an" do not denote a limitation of quantity, but rather denote the presence of at least one of the referenced item. The modifier "about" used in connection with a quantity is inclusive of the stated value and has the meaning dictated by the context (e.g., includes the degree of error associated with measurement of the particular quantity).

Figure 1:
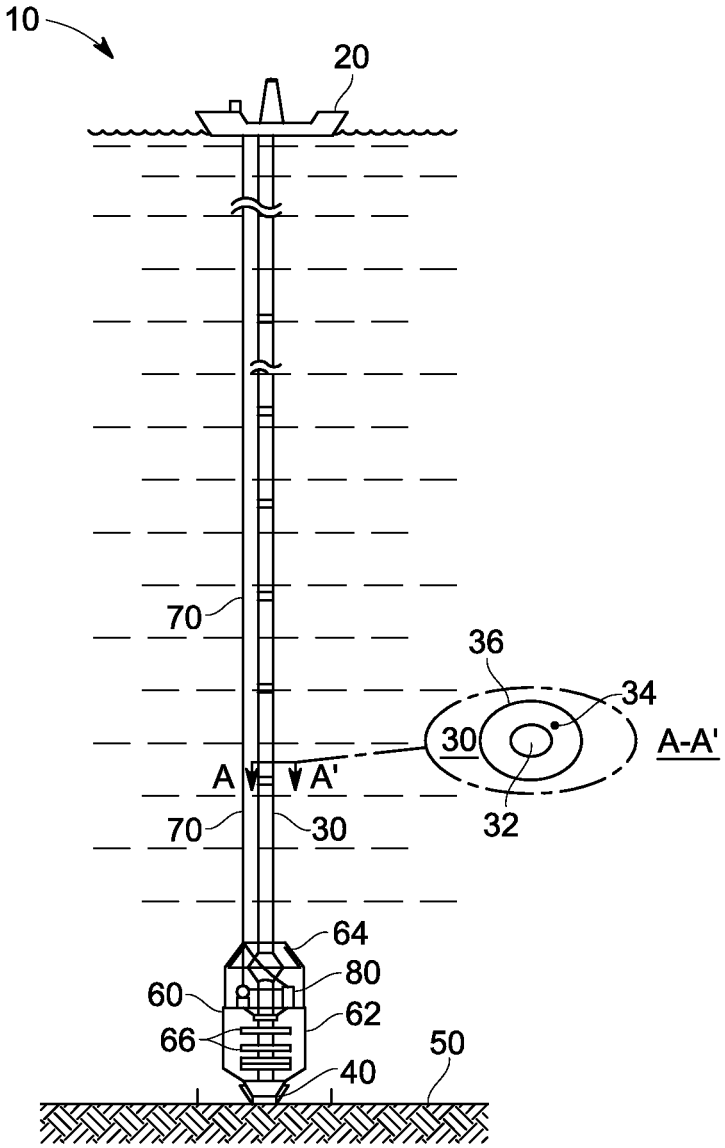
FIG. 1 (PRIOR ART)
FIG. 1 is a schematic diagram of a conventional offshore drilling rig.
Figure 2:
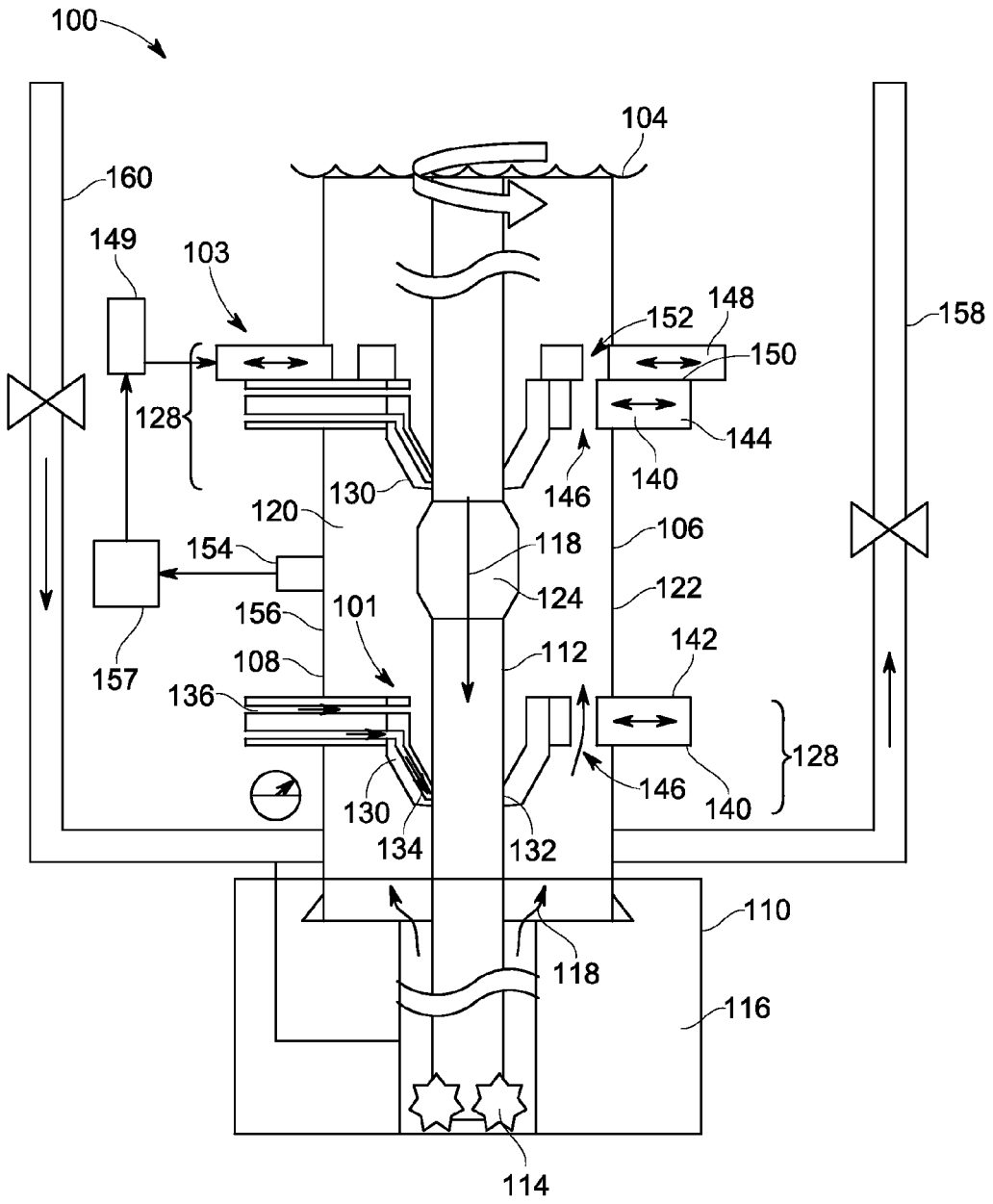
FIG. 2 is a schematic diagram of an apparatus for controlling well influx within a wellbore, according to an exemplary embodiment.
Figure 3:
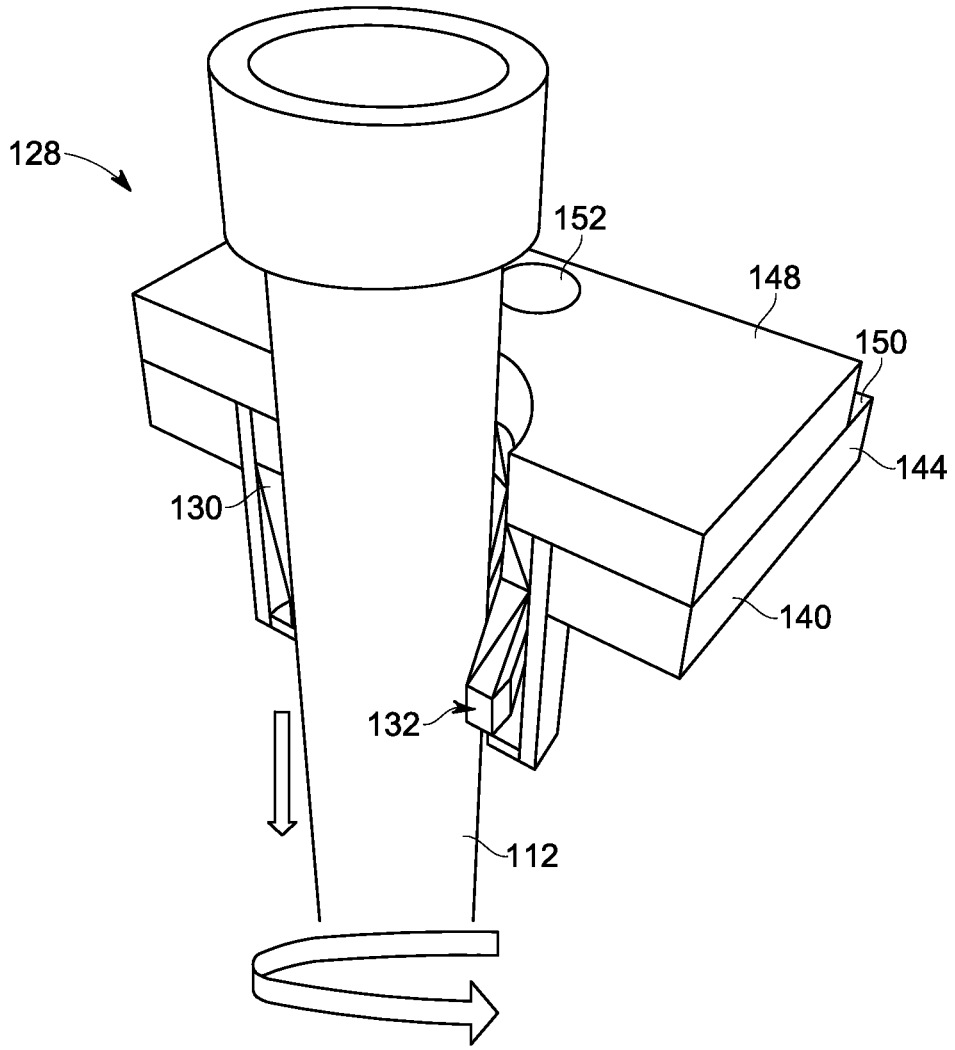
FIG. 3 is a schematic diagram of a portion of a centralizer and flow constrictor assembly installed about a drill string of FIG. 2, according to an exemplary embodiment.
Figure 4:
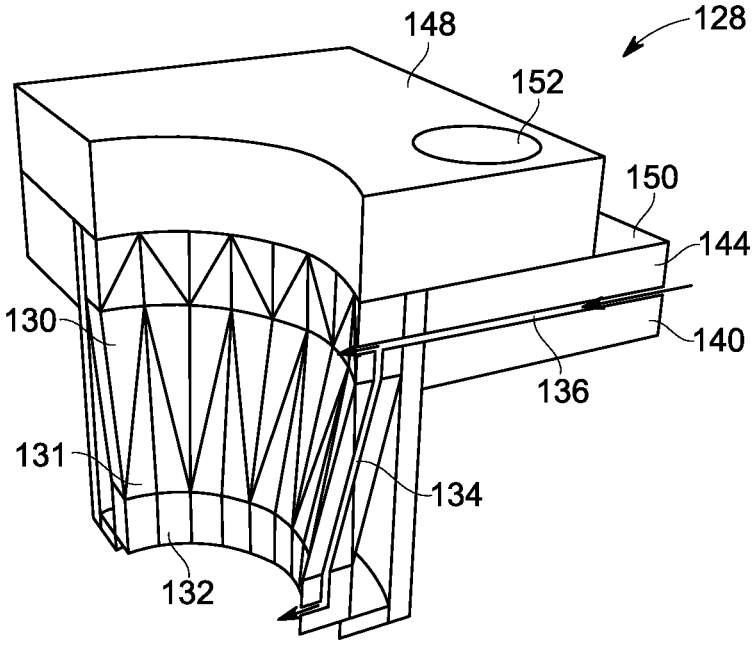
FIG. 4 is a schematic diagram illustrating the lubrication feeds in a ram plate and a flexible element bearing of FIG. 2, according to an exemplary embodiment.
Figure 5:
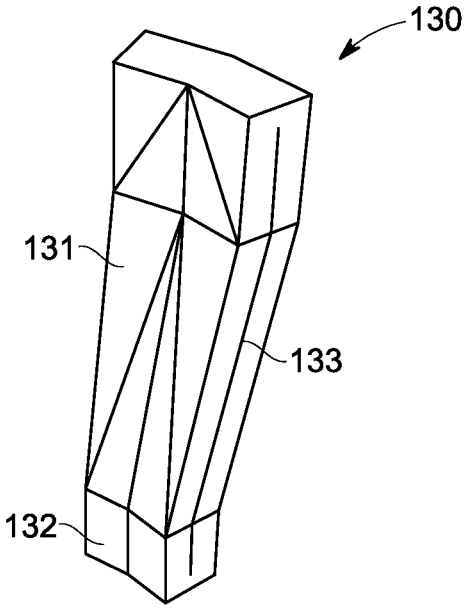
FIG. 5 is a schematic diagram illustrating a portion of a flexible element bearing of FIG. 2, according to an exemplary embodiment.

In one aspect, embodiments disclosed herein relate to subsea stack assemblies. FIGS. 2-5 illustrate schematic diagrams of an exemplary embodiment of an apparatus 100 useable in an offshore drilling installation and more particularly a seabed well influx control system 102 for controlling well influx within a wellbore. FIG. 3 is a partial cut-away view of a centralizer and flow constrictor assembly of the apparatus 100. FIG. 4 is a schematic diagram illustrating a plurality of lubrication feeds in the apparatus 100 and FIG. 5 is a schematic diagram illustrating a portion of a flexible element bearing of the apparatus 100, all according to an exemplary embodiment.

The apparatus 100 includes a centralizer component 101 and a flow constrictor component 103 and is configured to automatically sense and regulate a returning mud flow in a mud loop as a means for detecting an increase in pressure and preventing a potential blowout condition. As illustrated in FIG. 2, the apparatus includes a platform (not shown) or any other type of vessel at the water surface 104 connected via a riser 106 to a wellhead 108 on the seabed 110. It is noted that the elements shown in the Figures are not drawn to scale and no dimensions should be inferred from relative sizes and distances illustrated in the Figures.

Inside the riser 106, there is disposed a drill string 112 at the end of which a drill bit 114 is rotated to extend the subsea well through layers 116 below the seabed 110. Mud, indicated by arrows 118, is circulated in a mud loop, from a mud tank (not shown) on the drilling platform through the drill string 112 to the drill bit 114, and returned to the drilling platform through an annular space 120 between the drill string 112 and a casing 122 of the riser 106. In order to protect the well and/or the equipment that may be damaged during increased pressure conditions, the seabed well influx control system 102 includes a plurality of spaced apart centralizer and flow constrictor assemblies 128 positioned proximate the drill string 112 and located close to the seabed 110. The plurality of centralizer and flow constrictor assemblies 128 are configured in a vertical spaced apart relationship about the drill string 112 and in a manner to center and hold the drill string 112 within the casing 122 and provide for constriction of the mud flow therethrough, as desired.

Each of the centralizer and flow constrictor assemblies 128, and more particularly the centralizer component 101, includes a flexible element bearing 130 integrally formed therewith a blowout preventer (BOP) 140. As best illustrated in FIGS. 3-5, each of the flexible element bearings 130 includes a flexible face 132 and a plurality of high pressure lubrication feeds, or orifices, 134 formed therethrough. In an embodiment, each of the plurality of flexible element bearings 130 is formed of a plurality of segments 131, each of which may include steel inserts, such as steel springs, wedges, or as illustrated in FIG. 5, a leaf spring 133. Each of the plurality of flexible element bearings are formed of a flexible material, such as elastomer, rubber, or the like.

During the drilling process, the flexible element bearing 130 is capable of flexing to provide for insertion therethrough of a drill string tool joint 124. The flexible face 132 of each flexible element bearing 130 is configured to provide sealing between the drill string 112 and the flexible face 134 during drilling operations. The plurality of high pressure lubrication feeds 134 are configured in fluidic communication with a plurality of high pressure fluid feeds 136 formed in each of the blow out preventers 140, and more particularly ram plates (described presently). Lubrication may be provided by pumping drilling mud or an external fluid at pressures above that of the wellbore to ensure bias leakage of mud/fluid into the well, thus sealing any mud 118 to travel in an upward direction and around the drill string 112 due to kick. In an embodiment, the high pressure lubrication feeds 134, 136 are configured to supply a drilling fluid which acts as a lubricant between the drill string 112 and the flexible face 132 during the drilling operation, as well as between the flexible element bearing 130 and the drill string tool joint 124 during drilling operations.

In the disclosed embodiment, each of the plurality of flexible element bearings 130 is integrally formed with one of the plurality of blowout preventers (BOPs) 140. Each of the plurality of blow out preventers 140 is configured as split ram blow out preventers, such as those commonly known in the art and additionally serves to centralize and hold the drill string 112 centered within the riser 106. In an embodiment, a first ram plate 142 is positioned proximate the seabed 110 and a second ram plate 144 is positioned in a spaced apart relationship from the first ram plate 142, and above the first ram plate 142, relative to the seabed 110. Each of the first and second ram plates 142, 144 include an opening 146 formed therein in a manner providing for the flow of mud 118, initially pumped in a downward direction through the drill string 112, to flow in an opposed, upward direction and back toward the water surface 104 through the riser 106 via the openings 146.

In addition, in the illustrated embodiment, at least an upper centralizer and flow restrictor assembly 128, and more particularly the flow constrictor component 103, includes a throttle plate 148. In an embodiment the throttle plate 148 is disposed on an uppermost surface 150 of the second ram plate 144, and having an opening 152 provided therein. The throttle plate 148 is operable to provide adjustment and/or constriction in the flow of mud 118 as it is returned through the riser 106 toward the water surface 104. Although only a single throttle plate 148 is illustrated in FIG. 2, it is anticipated that in an alternate embodiment a second redundant throttle plate (not shown) may be positioned on an uppermost surface of the first ram plate 142 and operable in case of failure of the primary throttle plate 148. The throttle plate 148 is configured as a valve and capable of regulating the returning mud flow 118, by modifying (increasing or decreasing) a surface of an annular opening 152 formed therein and in operable alignment/misalignment with the opening 146 formed in the second ram plate 144 to increase or decrease in size. The throttle plate 148 is in an open state, with openings 152 in alignment with openings 146, during normal operation, but may be closed (i.e., switched to a closed state) with openings 152 in misalignment, or at least partial misalignment, with openings 146, to interrupt a fluid flow through the riser 106 when under a high pressure event, such as when a "kick" occurs.

Throttling the flow using throttle plate is just one way to control flow. Other valve types may be designed/incorporated in to the RAM plates to allow control of flow.

A sensor 154 is located on the riser 106, and more particularly, on an outer surface 156 of the casing 122, disposed between the first ram plate 122 and the second ram plate 124. The sensor 154 is configured to acquire information related to a mud flow returning from the bottom of the well. A distance from a source of the mud (i.e., a mud tank of a platform at the water surface) to the seabed may be thousands of feet. Therefore it may take a significant time interval (minutes or even tens of minutes) until a change of a parameter (e.g., pressure or flow rate) related to the mud flow becomes measurable at the surface. Placement of the sensor between the first ram plate 122 and the second ram plate 124 minimizes errors in reading flow rate which arise due to the orbiting of the drill string 112 and minimizes response time.

The throttle plate 148 is actuated via actuators 149 (hydraulic or electrical) after receiving commands from a controller 157 that has received a signal from the sensor 154. Sensor 154 primarily measures flow velocity as a means of detecting kick. Change in velocity above a certain percentage of normal velocity is considered a kick which starts the control process. In an embodiment, the controller 156 is configured to automatically control the throttle plate 148 based on the values received by the sensor 154, in order to regulate the returning mud flow towards achieving a value of a control parameter close to a predetermined value. Automatically controlling means that no signal from the surface is expected or required. However, this mode of operating does not exclude a connection between the control loop and an external operator that may enable occasional manual operation or receiving new parameters, such as, the predetermined value.

In one embodiment, the sensor 154 may include a pressure sensor and the control parameter may be the measured pressure or another parameter that may be calculated based on the measured pressure. The controller 156 controls the throttle plate 148 to slideably misalign the opening 152 relative to the opening 146 thereby decreasing the flow and, thus, the dynamic pressure if the pressure is larger than a set value, such as when under a high pressure event. Likewise, the controller 156 controls the throttle plate 148 to slideably align the opening 152 relative to the opening 146 thereby increasing the flow and, thus, the dynamic pressure if the pressure is smaller than the set value. The controlled pressure may be the pressure below the throttle plate 148 or near a bottom of the well.

In another embodiment, the sensor 154 may also include a flow meter measuring the mud flow therethrough, and the control parameter may be the mud flow itself. The controller 156 then controls the throttle plate 148 to close off the opening 152 if the mud flow is larger than a set value, or to maintain the opening 152 in an open position if the mud flow is smaller than the set value. Yet in another embodiment the controller 156 may receive information about both the amount of returning mud flow from a mud flow meter and pressure from a pressure sensor.

In addition, as illustrated in FIG. 2, included are choke and kill (C/K) feed-thrus (or lines) 158, 160, respectively, running alongside an exterior of the drilling riser 106, as commonly known in the art. The C/K feed-thrus 158, 160 are operational to provide an input of heavier drilling mud down the well bore through the kill feed-thru 160, while the choke feed-thru 158 is used to control the flow during drilling and high pressure events.

Figure 6:
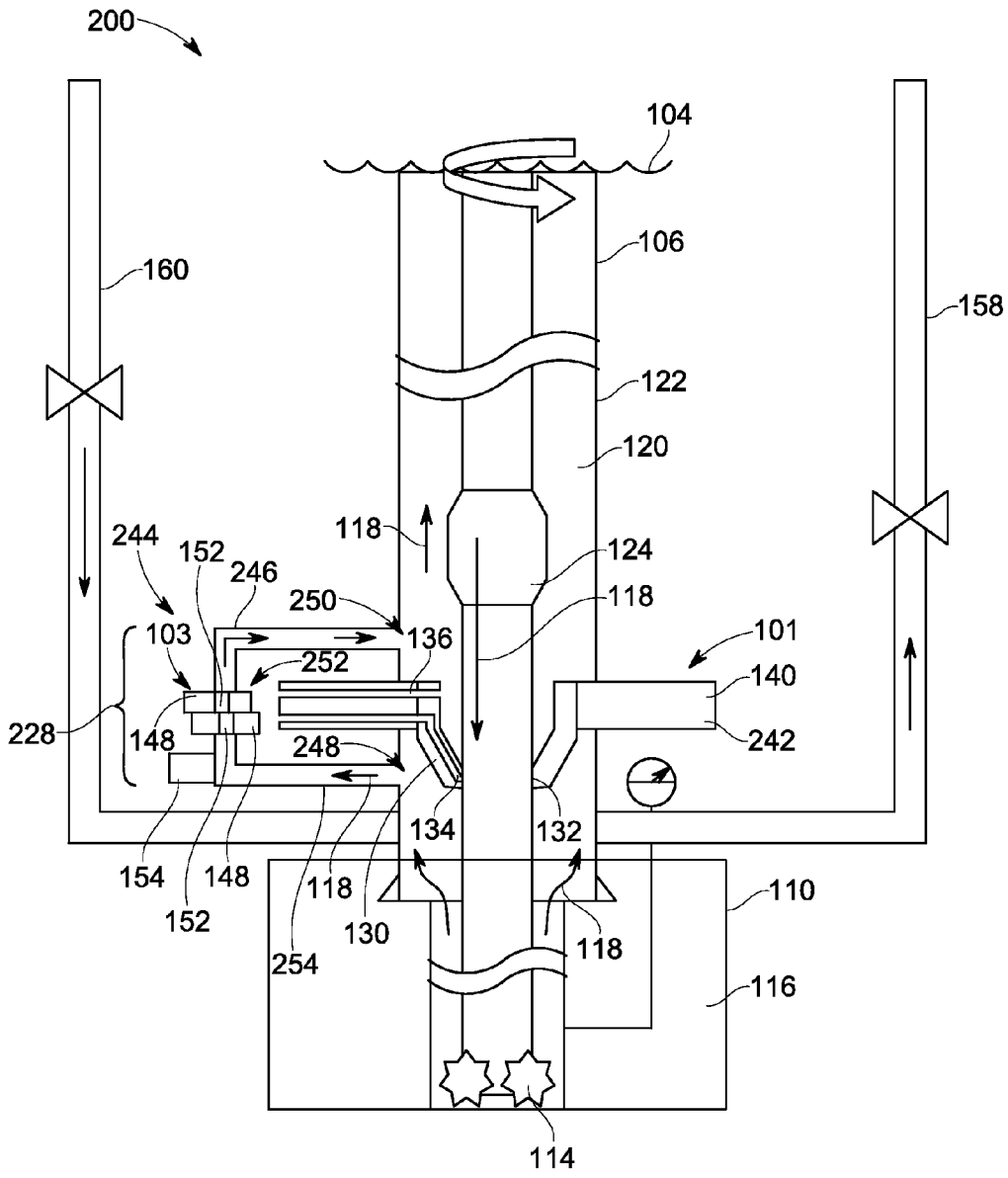
FIG. 6 is a schematic diagram of an apparatus for controlling well influx within a wellbore, according to another exemplary embodiment.

Referring now to FIG. 6, illustrated is a schematic diagram of an exemplary embodiment of an apparatus 200 useable in an offshore drilling installation and more particularly, a seabed well influx control system 202. As previously indicated, it should be understood that like numerals are used to refer to like and corresponding parts of the various drawings.

In contrast to the previously disclosed embodiment, the apparatus 200 includes a single centralizer and flow constrictor assembly 228, and more particularly a single centralizer component 101 and a single flow constrictor component 103. As illustrated in FIG. 6, the apparatus includes a riser 106 to connect a platform, or the like (not shown), to a wellhead 108 on the seabed 110. Inside the riser 106, is the drill string 112 at the end of which is the drill bit 114 to extend the subsea well through layers 116 below the seabed 110. Mud, indicated by arrows 118, is circulated through the drill string 112 to the drill bit 114, and returned to the drilling platform through an annular space 120 between the drill string 112 and a casing 122 of the riser 106 via the single flow constrictor component 103. In order to protect the well and/or the equipment that may be damaged during increased pressure conditions, the seabed well influx control system 202 includes the single centralizer and flow constrictor assembly 228 positioned proximate the drill string 112 and located close to the seabed 110. The centralizer and flow constrictor assembly 228 is configured about the drill string 112 and in a manner to center and hold the drill string 112 within the casing 122 and provide for constriction of the flow therethrough.

The centralizer and flow constrictor assembly 228 includes a flexible element bearing 130 integrally formed therewith a blowout preventer (BOP) 140 as previously described with regard to FIG. 2-5. The flexible element bearing 130 includes a flexible face 132 and a plurality of high pressure lubrication feeds, or orifices, 134 formed therethrough. The flexible element 130 is configured to flex for insertion and lubrication of the drill string tool joint 124. The flexible element bearing 130 provides sealing between the drill string 112 and the flexible face 132 during drilling operation. The plurality of high pressure lubrication feeds 134 are configured in fluidic communication with a plurality of high pressure fluid feeds 136 formed in the ram plate (described presently).

Similar to the previously disclosed embodiment, the blow out preventer 140 is configured as split ram blow out preventer and serves to centralize and hold the drill string 112 centered within the riser 106. In this particular embodiment, due to the inclusion of a bypass assembly as will be described, the drill string 112 is sufficiently maintained in a centralized position with the use of a single centralizer component 101. Illustrated in FIG. 6 is a ram plate 242 positioned proximate the seabed 110. In contrast to the previously described embodiment, the ram plate 242 does not include an opening formed therein in a manner providing for the flow of mud 118 therethrough as it is returned to the water surface 104. In this particular embodiment, the flow of mud 118 is initially pumped in a downward direction through the drill string 112, to flow in an opposed, upward direction and back toward the water surface 104 through a bypass assembly 244 and into the riser 106.

In an embodiment, the bypass assembly 244 includes a conduit 246 in fluidic communication with the riser 106 at a conduit inlet 248 and a conduit outlet 250. The conduit 246 includes a throttle assembly 252 disposed therein. The throttle assembly 252 includes a plurality of throttle plates 148 each having an opening 152 provided therein. The throttle plates 148 are operable to provide adjustment and/or constriction in the flow of mud 118 as it is returned through the riser 106 toward the water surface 104 via the conduit 246, and more particularly from a first side 255 of the single centralizer component 10) to a second side 257 of the single centralizer component 10. More specifically, at least one of the throttle plates 252 is moveable relative to the additional throttle plate 148 to align/misalign the openings 152 formed therein, respectively. The throttle assembly 252 is in an open state during normal operation, but may be closed (i.e., switched to a closed state) to interrupt a fluid flow through the riser 106 when under a high pressure event, such as when a "kick" occurs.

A sensor 154 is located on the conduit 246, and more particularly, on an outer surface 254 of the conduit 246. The sensor 154 is configured similar to that described in FIG. 2. Placement of the sensor on the bypass assembly 244, and more particularly the conduit 246, provides for a decrease in sensitivity of the sensor 154 to movement or vibration due to the drill string 112 orbiting and minimizes throttle constriction response time.

The throttle plates 148 are configured as a valve and capable of regulating the returning mud flow 118, by modifying (increasing or decreasing) a surface of the annular openings 152 formed therein and operable by alignment/misalignment of the openings 152 to increase or decrease in size. It is anticipated that in an alternate embodiment, the throttle plates 148 may be replaced by any type of valve operational to constrict the flow therethrough the conduit 246, such as a gate valve, or the like. In an embodiment, the throttle plates 148 are controlled by a controller 156 connected to the sensor 154 and operational as previously described. More particularly, the controller 156 controls the throttle plates 148 to slideably misalign the openings 152 thereby decreasing the flow and, thus, the dynamic pressure if the pressure is larger than a set value. The controller 156 controls the throttle plates 148 to slideably align the openings 152 thereby increasing the flow and, thus, the dynamic pressure if the pressure is smaller than the set value. In addition, as illustrated in FIG. 6, included are kill and choke lines 158, 160, respectively, running alongside an exterior of the drilling riser 106, as commonly known in the art.

Figure 7:
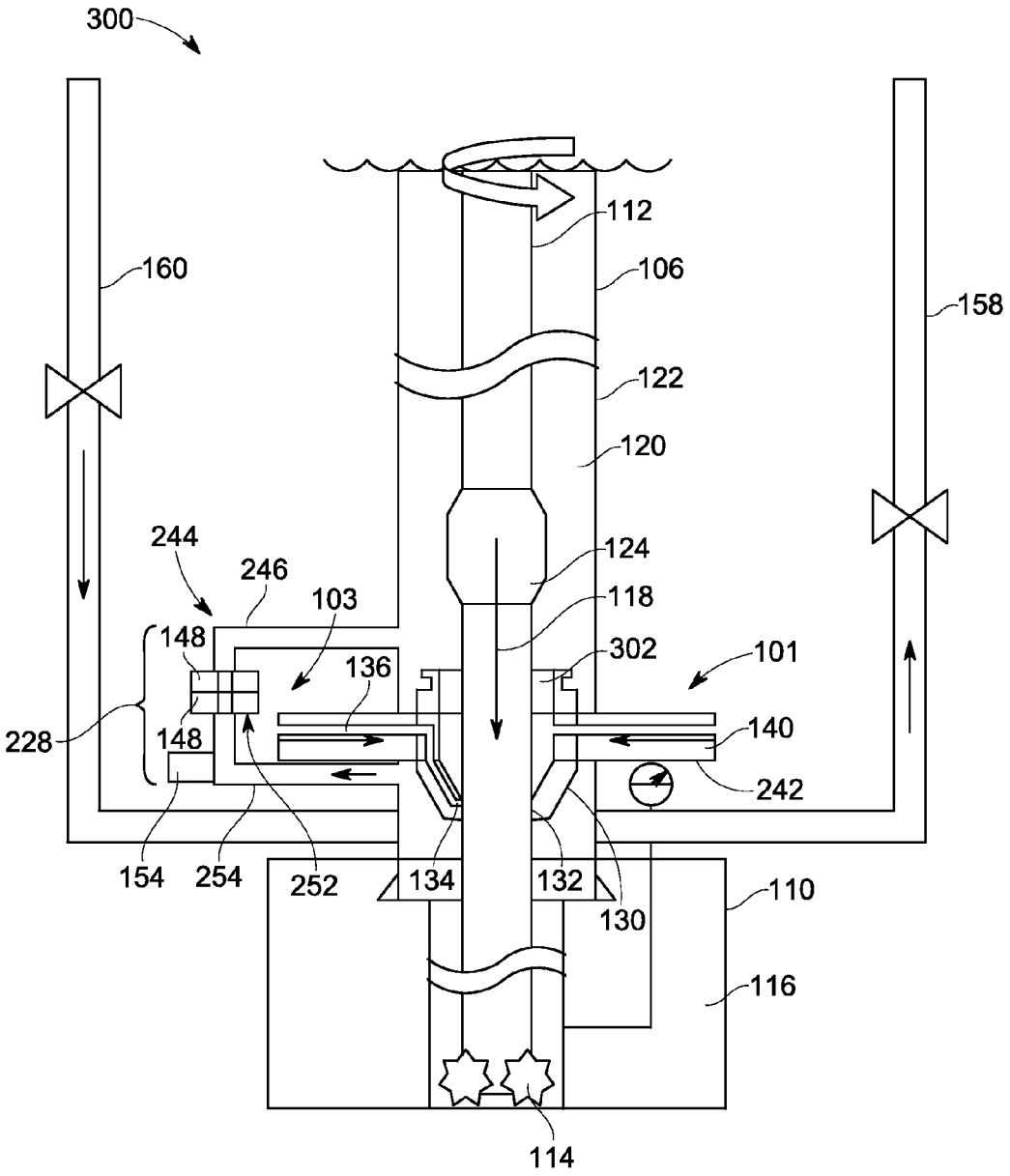
FIG. 7 is a schematic diagram of an apparatus for controlling well influx within a wellbore, according to another exemplary embodiment.

Referring now to FIG. 7, illustrated is an embodiment similar to the embodiment illustrated in FIG. 6, except in this particular embodiment, disclosed is an apparatus 300 including a single centralizer and flow constrictor assembly 228, and more particularly a single flow constrictor component 103 and a single centralizer component 101, including a one-piece annular head 302 and means for lubrication. As illustrated in FIG. 7, the apparatus is configured generally similar to the previously described embodiment illustrated in FIG. 6 including a riser 106, a drill string 112, a ram plate 242 and bypass assembly 244.

In the embodiment illustrated in FIG. 7, the centralizer component 101 includes the one-piece annular bearing 302 having formed therein plurality of high pressure fluid feeds 134 in alignment with a plurality of high pressure feeds 136 formed in the ram plate 140. Additional information on the one-piece annular bearing 302 can be found, for example, in U.S. Publication No. 2008/0023917 (the entire contents of which are incorporated by reference herein). The inclusion of the one-piece annular bearing 302 provides an improved design that serves to improve the stability of the drill string 112 and bearing surfaces during orbiting of the drill string 112.

Although the above-described embodiments have been described for an offshore drilling installation, similar embodiments may be integrated in land-based drilling installations.

The disclosed exemplary embodiments provide apparatuses for well influx control, and more particularly provide for the continuation of drilling operation when a potential well bore kick condition is detected in an offshore installation. In addition, due to the proximity of the sensor, flow constrictor assembly and controller, the control is performed promptly (e.g., less than a tenth of a second between detection and corrective action, as opposed to minutes in the conventional approach) and can be performed frequently (e.g., few times every second).

At least some of the embodiments result in an increase of safety. A response time for return flow variation is significantly reduced without requiring expensive equipment or shut down of the drilling operation. The rotating wellhead areis configured as an integral part of the BOP stack and therefore require minimal seals to stop the flow of mud through the annulus. These enhancements result in better control of the pressure of the bottom of the well and maintaining the equivalent circulating pressure within a narrower range. Due to the better control of the pressure at the bottom of the well the formation damage and shut down occurrences are reduced and fewer situations of stuck drill pipe occur.

It should be understood that this description is not intended to limit the invention. On the contrary, the exemplary embodiments are intended to cover alternatives, modifications and equivalents, which are included in the spirit and scope of the invention as defined by the appended claims. Further, in the detailed description of the exemplary embodiments, numerous specific details are set forth in order to provide a comprehensive understanding of the claimed invention. However, one skilled in the art would understand that various embodiments may be practiced without such specific details.

Although the features and elements of the present exemplary embodiments are described in the embodiments in particular combinations, each feature or element can be used alone without the other features and elements of the embodiments or in various combinations with or without other features and elements disclosed herein.

This written description uses examples of the subject matter disclosed to enable any person skilled in the art to practice the same, including making and using any devices or systems and performing any incorporated methods. The patentable scope of the subject matter is defined by the claims, and may include other examples that occur to those skilled in the art. Such other examples are intended to be within the scope of the claims.

While the present disclosure has been described with respect to a limited number of embodiments, those skilled in the art, having benefit of this disclosure, will appreciate that other embodiments may be devised which do not depart from the scope of the disclosure as described herein. While the present disclosure has been described with reference to exemplary embodiments, it will be understood by those skilled in the art that various changes may be made and equivalents may be substituted for elements thereof without departing from the scope of the disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out the disclosure. It is, therefore, to be understood that the appended claims are intended to cover all such modifications and changes as fall within the true spirit of the disclosure.

The invention claimed is:

1. An apparatus useable in an offshore drilling installation close to the seabed for controlling well influx within a wellbore comprising:

a centralizer and flow constrictor assembly configured to centralize a drill string within a drill riser and regulate a return mud flow, the centralizer and flow constrictor assembly comprising at least one centralizer component comprised of a ram plate and a flexible element bearing configured to seal about the drill string while allowing rotation of the drill string and a flow constrictor component;

a sensor located close to the centralizer and flow constrictor assembly and configured to acquire values of at least one parameter related to the return mud flow; and a controller coupled to the centralizer and flow constrictor assembly and the sensor, the controller configured to control the centralizer and flow constrictor assembly to achieve a value of a control parameter close to a predetermined value, based on the values acquired by the sensor.

2. The apparatus of claim 1, wherein the flexible element bearing and the ram plate include high pressure fluid feeds formed therein and configured to provide lubrication to the bearing surface.

3. The apparatus of claim 2, wherein the flow constrictor component is comprised of at least one throttle plate, including an opening therein for the return mud flow, the throttle plate operable to regulate the return mud flow.

4. The apparatus of claim 3, wherein the centralizer and flow constrictor assembly comprises:

a first centralizer component;

a spaced apart second centralizer component; and a throttle plate disposed on an uppermost surface of the second centralizer component, wherein the first and second centralizer components each comprise a ram plate having an opening therein for the return mud flow.

5. The apparatus of claim 4, wherein the sensor is disposed on the drill riser between the first centralizer component and the second centralizer component.

6. The apparatus of claim 5, wherein the sensor is configured to measure at least one of a measured pressure or a mud flow density.

7. The apparatus of claim 3, wherein the centralizer and flow constrictor assembly comprises a single centralizer component and a bypass assembly configured to provide the return mud flow from a first side of the single centralizer component to a second side of the single centralizer component.

8. The apparatus of claim 7, wherein the bypass assembly comprises a conduit having a valve disposed between a conduit inlet and a conduit outlet and operable to regulate the return mud flow.

9. The apparatus of claim 8, wherein the valve is comprised of a plurality of throttle plates each including an opening therein for the return mud flow.

10. The apparatus of claim 9, wherein the sensor is disposed on the conduit between the conduit inlet and the valve.

11. The apparatus of claim 10, wherein the centralizer component further comprises an annular one-piece head.

12. An apparatus useable in an offshore drilling installation close to the seabed for controlling well influx within a wellbore comprising:

a drill riser including a cavity extending from an annular space through which a return mud flow passes, the annular space surrounding a drill string through which mud flows towards a top of the well;

a centralizer and flow constrictor assembly comprising:

a first centralizer component and a spaced apart second centralizer component configured to centralize the drill string within the drill riser and a flow constrictor component configured to regulate the return mud flow, the first and second centralizer components each comprising:

a flexible element bearing surface configured to seal about the drill string while allowing rotation of the drill string; and a ram plate having an opening therein for the return mud flow;

a sensor disposed between the first and second centralizer components, located close to the seabed and configured to acquire values of at least one parameter related to the return mud flow; and a controller coupled to the centralizer and flow constrictor assembly and the sensor, the controller configured to control the centralizer and flow constrictor assembly to achieve a value of a control parameter close to a predetermined value, based on the values acquired by the sensor.

13. The apparatus of claim 12, wherein the flow constrictor component comprises a throttle plate disposed on an uppermost surface of the second centralizer component and including an opening therein for the return mud flow, the throttle plate operable to regulate the return mud flow.

14. The apparatus of claim 12, wherein the flow constrictor component comprises a bypass assembly configured for the return mud flow, the bypass assembly including a conduit having a valve disposed between a conduit inlet and a conduit outlet and configured to regulate the return mud flow.

15. The apparatus of claim 14, wherein the valve is comprised of a plurality of throttle plates each including an opening therein for the return mud flow and operable to regulate the return mud flow, and wherein the sensor is disposed on the conduit between the conduit inlet and the valve.

16. An apparatus useable in an offshore drilling installation close to the seabed for controlling well influx within a wellbore comprising:

a drill riser including a cavity extending from an annular space through which a return mud flow passes, the annular space surrounding a drill string through which mud flows towards a top of the well;

a centralizer and flow constrictor assembly comprising:

a first centralizer component;

a spaced apart second centralizer component;

a sensor disposed between the first and second centralizer components; and a flow constrictor component comprising a throttle plate disposed on an uppermost surface of the second centralizer component and including an opening therein for the return mud flow, the throttle plate operable to regulate the return mud flow, wherein the first and second centralizer components each comprise:

a flexible element bearing including a bearing surface configured to seal about the drill string while allowing rotation of the drill string; and a ram plate having an opening therein for the return mud flow, the sensor located close to the seabed and configured to acquire values of at least one parameter related to the return mud flow; and a controller coupled to the centralizer and flow constrictor assembly and the sensor, the controller configured to control the centralizer and flow constrictor assembly to achieve a value of a control parameter close to a predetermined value, based on the values acquired by the sensor.

17. The apparatus of claim 16, wherein the flexible element bearing and the ram plate include high pressure fluid feeds formed therein and configured to provide lubrication to the bearing surface.

18. The apparatus of claim 16, wherein the sensor is configured to measure at least one of a measured pressure or a mud flow density.

* * * * *